US011253076B2

(12) United States Patent
Motley et al.

(10) Patent No.: US 11,253,076 B2
(45) Date of Patent: Feb. 22, 2022

(54) CHAIR HAVING OPEN SHOULDER BACKREST

(71) Applicant: Unchair LLC, Canton, MI (US)

(72) Inventors: Adam Motley, Canton, MI (US); Ivan Calvachi, Kearny, NJ (US); William Belcher, Indianapolis, IN (US)

(73) Assignee: Unchair LLC, Canton, MI (US)

( * ) Notice: Subject to any disclaimer, the term of this patent is extended or adjusted under 35 U.S.C. 154(b) by 0 days.

(21) Appl. No.: 16/782,911

(22) Filed: Feb. 5, 2020

(65) Prior Publication Data

US 2020/0245769 A1 Aug. 6, 2020

Related U.S. Application Data

(60) Provisional application No. 62/801,268, filed on Feb. 5, 2019.

(51) Int. Cl.
*A47C 7/40* (2006.01)
*A47C 7/44* (2006.01)
(Continued)

(52) U.S. Cl.
CPC ..... *A47C 7/462* (2013.01); *A47C 7/38* (2013.01); *A47C 7/44* (2013.01); *A47C 7/004* (2013.01); *A47C 7/402* (2013.01)

(58) Field of Classification Search
CPC ..... A47C 7/004; A47C 7/38; A47C 7/402; A47C 7/44; A47C 7/462
(Continued)

(56) References Cited

U.S. PATENT DOCUMENTS 1,977,702 A 10/1934 Summerlee et al.
2,364,261 A 12/1944 Wood
(Continued)

FOREIGN PATENT DOCUMENTS

CA 2798532 A1 * 12/2011 ..... A47C 7/54
CA 2953773 A1 * 6/2018 ..... A47C 7/029
(Continued)

OTHER PUBLICATIONS

HAG Capisco Ergonomic Seat, 2020, https://store.flokk.com/us/en-gb/products/hag-capisco?model=8127-STD&store=auto.
(Continued)

*Primary Examiner* — Rodney B White
(74) *Attorney, Agent, or Firm* — Endurance Law Group PLC

(57) ABSTRACT

An ergonomically improved chair in which the user's thoracic region is supported by a narrow and generally flat or moderately convex thoracic cushion in the midrest region of the chairback. The design omits or greatly minimizes support for the user's scapulae and other areas of the back outside the thoracic region, excepting lumbar and cervical support features in some embodiments. The design differs from the prior art at least in that the thoracic cushion is narrow and configured not to complement that user's spinal curvature. By appropriate selection and design, a chair incorporating the invention may comprise a fabric covering portions of the chairback without significantly affecting functionality. Other embodiments include a chairback comprising regions having differing levels of firmness and/or differing cushion height at appropriate regions to promote concentrated support of the user's thoracic region.

9 Claims, 14 Drawing Sheets

(51) Int. Cl.
*A47C 7/46* (2006.01)
*A47C 7/38* (2006.01)
*A47C 7/00* (2006.01)

(58) Field of Classification Search
USPC ... 297/195.1, 195.11, 284.4, 452.41, 452.56, 297/284.7
See application file for complete search history.

(56) References Cited

U.S. PATENT DOCUMENTS 2,667,210 A 1/1954 Charles
3,288,525 A * 11/1966 Cerf ..... A47C 7/462 297/284.8
D214,119 S * 5/1969 Worley ..... D6/716.4
3,574,396 A * 4/1971 Bird ..... B62J 6/20 297/215.11
3,741,596 A * 6/1973 Cate ..... B62J 6/04 297/215.11
3,883,176 A 5/1975 Morton
3,989,297 A 11/1976 Kerstholt
4,032,190 A 6/1977 Muller-Deisig et al.
4,607,882 A * 8/1986 Opsvik ..... A47C 7/029 297/195.11
4,864,668 A 9/1989 Crisp
D320,120 S 9/1991 Samuelsson
5,112,106 A 5/1992 Asbjornsen et al.
5,501,507 A * 3/1996 Hummitzsch ..... A47C 7/405 297/284.4
5,575,534 A 11/1996 Yu
5,624,158 A 4/1997 Adat et al.
5,685,613 A * 11/1997 Franzen, Jr. ..... A47G 9/10 297/284.5 X
5,897,472 A * 4/1999 Thulasingam ..... A47C 9/00 297/284.4
5,908,221 A 6/1999 Neil
5,975,632 A * 11/1999 Ginat ..... A47C 7/462 297/284.4
6,059,362 A * 5/2000 Lin ..... A47C 7/425 297/284.4
6,394,547 B1 5/2002 Vik
6,419,318 B1 * 7/2002 Albright ..... A47C 7/462 297/284.4
6,626,494 B2 9/2003 Yoo
D501,333 S 2/2005 Piretti
6,938,956 B1 9/2005 Piretti
6,969,114 B2 11/2005 Keilhauer
D512,231 S * 12/2005 Landin Lorentzen ..... D6/366
7,059,678 B1 * 6/2006 Taylor ..... A47C 7/405 297/284.4
7,195,583 B2 3/2007 Leib
7,249,802 B2 * 7/2007 Schmitz ..... A47C 7/282 297/284.4 X
D547,959 S 8/2007 Adams
7,396,082 B2 7/2008 Sanchez
7,419,222 B2 * 9/2008 Schmitz ..... A47C 1/03 297/284.4 X
7,425,037 B2 * 9/2008 Schmitz ..... A47C 1/03266 297/300.2
7,585,028 B2 9/2009 Jenkins
7,625,046 B2 * 12/2009 Sanchez ..... A47C 7/402 297/284.4 X
7,703,849 B2 * 4/2010 Bilak ..... A47C 7/462 297/284.6
7,731,295 B2 * 6/2010 Lin ..... A47C 7/282 297/452.56
7,841,666 B2 * 11/2010 Schmitz ..... A47C 7/46 297/284.7 X
7,909,402 B2 3/2011 Chu et al.
D646,511 S 10/2011 Ballendat
8,029,060 B2 10/2011 Parker et al.
8,061,778 B2 11/2011 Machael et al.
D661,916 S 6/2012 Chen
8,449,037 B2 * 5/2013 Behar ..... A47C 7/40 297/452.56
8,573,697 B1 * 11/2013 Su ..... A47C 7/462 297/284.7
8,696,534 B2 4/2014 Karwan
8,864,230 B2 10/2014 Augustat
8,926,016 B2 * 1/2015 Behar ..... A47C 7/46 297/284.4
9,049,936 B2 6/2015 Leone et al.
9,131,775 B1 * 9/2015 Eisenberg ..... A63B 23/0211
9,138,061 B1 * 9/2015 Eisenberg ..... A47C 1/03261
9,226,582 B2 * 1/2016 Jenkins ..... A47C 1/03279
9,301,615 B2 * 4/2016 Behar ..... A47C 5/12
D763,588 S 8/2016 Chen et al.
9,480,340 B1 * 11/2016 Harlow ..... A47C 7/006
9,585,478 B1 * 3/2017 Eisenberg ..... A47C 7/02
D784,748 S * 4/2017 Tsai ..... D6/716.4
D804,879 S 12/2017 Harlow
10,021,983 B2 7/2018 Mark
10,226,129 B2 3/2019 Christianson et al.
10,272,282 B2 * 4/2019 Harlow ..... A47C 7/441
D870,478 S * 12/2019 Mason ..... D6/366
10,667,612 B2 * 6/2020 Matlin ..... A47C 7/006
D897,707 S * 10/2020 Mason ..... D6/366
10,827,841 B1 * 11/2020 Tsai ..... A47C 7/402
10,973,725 B2 * 4/2021 Mason ..... A47C 1/024
2005/0062323 A1 * 3/2005 Dicks ..... A47C 7/402 297/284.4
2005/0104428 A1 * 5/2005 Walker ..... A47C 7/402 297/284.4
2005/0189810 A1 * 9/2005 Wu ..... A47C 7/38 297/452.29
2005/0275263 A1 * 12/2005 Norman ..... A47C 7/46 297/284.4
2005/0275264 A1 * 12/2005 Norman ..... B60N 2/66 297/284.4
2006/0238006 A1 * 10/2006 Baranov ..... A47C 7/40 297/284.3
2010/0164266 A1 * 7/2010 Walters ..... B60N 2/163 297/337
2012/0193959 A1 * 8/2012 Chen ..... A47C 7/46 297/301.1
2013/0005550 A1 1/2013 Nagy
2016/0374474 A1 * 12/2016 Wu ..... A47C 7/462 297/284.4
2018/0116405 A1 * 5/2018 Gerbino ..... A47C 7/462
2019/0125609 A1 * 5/2019 Mason ..... A47C 7/541
2019/0223603 A1 * 7/2019 France ..... A47C 3/30

FOREIGN PATENT DOCUMENTS

CN 108887967 A * 11/2018 ..... A47C 7/462
DE 3824730 A1 * 1/1990 ..... B60N 2/38
DE 19848400 A1 * 5/2000 ..... A47C 7/462
EP 0970639 A1 * 1/2000 ..... A47C 7/462
FR 2842403 A1 * 1/2004 ..... A47C 3/029
GB 2561703 A * 10/2018 ..... A47C 7/462
JP H0795912 A 4/1995
JP 2005080677 A * 3/2005 ..... A47C 7/462
JP 2019084337 A * 6/2019 ..... A47C 7/462
KR 100322248 B1 10/2002
WO 1989009557 A1 10/1989
WO WO-2006010552 A1 * 2/2006 ..... A47C 7/462
WO WO-2008054225 A1 * 5/2008 ..... A47C 7/38
WO WO-2014196630 A1 * 12/2014 ..... A47C 7/40
WO 2017014661 A2 1/2017
WO WO-2019204714 A1 * 10/2019 ..... A47C 7/4454

OTHER PUBLICATIONS

Neutral Posture 8000 Series Brochure, 2018, http://www.neutralposture.com/_imgs/lit/spec-sheets/8000-Series_SS_20180207.pdf.
Office Master "Discovery Back" Series Brochure, Jun. 2013, www.officemaster.com.
RFM Carmel Chair (with "Thoracic Ridge") Brochure, http://rfmseating.com/wp-content/uploads/2018/09/2018-Carmel.pdf.

(56) References Cited

OTHER PUBLICATIONS

SOMA Backrest Chair, 2001, https://shop.healthydesign.com/assets/products/soma-ergo/soma-docs/SomaBackrests.pdf.

* cited by examiner

CHAIR HAVING OPEN SHOULDER BACKREST

CROSS REFERENCE TO RELATED APPLICATIONS

This application claims priority to Provisional Patent Application No. 62/801,268 filed Feb. 5, 2019, the entire disclosure of which is hereby incorporated by reference.

BACKGROUND OF THE INVENTION

Field of the Invention

The invention relates generally to chairs and more particularly to chairs featuring ergonomic design to reduce ache and fatigue occasioned by prolonged sitting, and to promote good posture.

The prior art reflects many attempts to address the problem of workplace fatigue and chronic aches arising from prolonged sitting, such as prolonged periods sitting at a computer monitor. A common approach is to employ a variety of adjustable settings to adjust the positioning and contours of the chair. A chair with only a few adjustable features, such seat height, platform tilt, or recline spring torsion may be adequate for some but lead to early fatigue in others. This has led to various approaches to adjust the configuration or responsiveness of the seatback. One of many examples is U.S. Pat. No. 6,394,547 (Vik) which features a vertically moveable seatback and adjustable lumbar support. Another is U.S. Pat. No. 6,626,494 (Yoo) also featuring a vertically adjustable seatback. Another is U.S. Pat. No. 5,624,158 (Adat) also featuring adjustable lumbar support. Another is U.S. Pat. No. 5,112,106 (Asbjornsen) featuring vertical adjustability and limited adjustability normal to the user's back, along a central spine or rail.

Similarly it is known to provide a chair backrest having an open shoulder area that does not significantly engage the user's shoulder blades (scapulae). Of course any chairback that terminates before reaching the user's scapulae will have open shoulders. However, many persons believe a higher chairback promotes better posture by deterring slouching. Some chairs do employ a higher chairback design and provide support to the thoracic region of the user's spine without significantly engaging the user's shoulder blades. An old example is the "Tuam" three-legged stool in which a third leg extends upwards to function as a narrow back rest. Several more modern office chairs feature an open shoulder chairback; a subset of these chairs include a headrest/neckrest feature. Some open shoulder designs include chairs marketed under the "Soma" brand, Office Master "Discovery Back" series, RFM Seating Corporation's "Carmel" series, Håg Capisco (model 81276), and seating support devices that may be utilized as a portable apparatus, such as U.S. Pat. No. 4,864,668 (Crisp) and U.S. Pat. No. 6,969,114 (Keilhauer).

Many earlier attempts to increase comfort during prolonged seating have sought to distribute back support more evenly. This may take the form of a chairback sculpted to conform to the S-shaped curvature of the human backbone, such as U.S. Pat. No. 6,969,114 (Keilhauer) which attempts to match a theoretically optimal seated spine curvature. Such sculpted chairbacks virtually always feature a midrest region having a concave chairback region that engages with the thoracic region of the user's spine, with the aim of complementing the natural dorsal curvature of the human spine in the thoracic region. However, varying sizes and shapes of users and their spines resists chair standardization.

A common feature of even the modern open-shoulder high-backed chairs is that the midrest portion of the chairback—the part that supports the thoracic region of the user—is wide relative to the width of the user's spine, especially in the lower thoracic region immediately above the lumbar region. Such designs continue to impose varying degrees of pressure/support on non-skeletal regions of the dorsal trunk in the lower thoracic zone lateral to the spine. Although such chairs may be adequate for some users, many users with back problems continue to experience discomfort. The "beam back" chair disclosed in KR20140008930A (Jung In Kim) suggests narrowly concentrating back support along the user's spine thereby avoiding the user's scapulae and other lateral dorsal regions. Like other attempts at improved chairback design, however, Kim's invention features a curved surface normal to the user's back to complement the user's spinal curvature, in order to distribute support across substantially all of the user's spine from lower lumbar to the cervical (neck) region (see Kim, FIGS. 1 and 6). Further, Kim requires complicated adjustment mechanisms to adapt to various spinal curvatures.

Adding a multitude of adjustable features gives rise to collateral problems. A multitude of mechanisms increases manufacturing expense, complicates user-operation, and increases the likelihood of a mechanism failing. Such multi-adjustable chairbacks, even if effective, are usually expensive. Further, achieving optimal adjustment of all the settings is tricky, and often the chair is only marginally effective at achieving the goal of increased comfort after prolonged sitting. Consequently many people who might benefit from a good ergonomic chair cannot afford it. There is a need for an affordable open-shoulder chair that concentrates thoracic support on the user's spine without sacrificing comfort, while being visually pleasing.

BRIEF SUMMARY OF THE INVENTION

The inventor has made the counterintuitive discovery that superior and prolonged seating comfort is achieved not by laterally and vertically distributing pressure across multiple regions of the user's back, nor is it achieved by attempting to match the curvature of the user's thoracic spinal region. Rather, the inventor discloses a chairback in which the user's back is supported mainly by a narrow and generally flat or moderately convex thoracic cushion in the midrest portion of the chairback that engages with the thoracic region of the user's spine without providing significant support to areas lateral to the user's spine. In one embodiment, the chairback comprises a narrow, flat, and relatively shallow cushion centered in the midrest providing support normal to the user's thoracic spinal region. In another embodiment, a narrow thoracic cushion is coupled with a proportionately larger lumbar support cushion below and transverse to the thoracic cushion. In another embodiment, the chairback may comprise a neckrest to support the user's cervical spinal region. In another embodiment, a fabric extending across the midrest may provide functionality and heighten aesthetic appeal without significantly detracting from the thoracic support primarily provided by the narrow thoracic cushion; the fabric could be a mesh and be installed in front of or behind one or both cushions. In another embodiment, the chairback may be comprised of a material such as molded urethane or polyurethane foam having regions of varying anterior elevation, comprising an elevated ridge along the thoracic region of the spine. In another embodiment, the aforesaid regions might have comparable anterior elevations but have different indentation load deflection values, comprising a very firm cushion region (high ILD) along the thoracic spinal region of the midrest, and comprising softer cushion region (lower ILD) normal to the user's scapulae, thereby concentrating thoracic support on the spine. In another embodiment, a central chairback element attached to a seat platform has a mechanism to limit deflection when the user reclines, providing firm support to the thoracic spinal region while abutting side elements have mechanisms permitting easier deflection, thereby concentrating thoracic support on the user's spine as in the other embodiments.

BRIEF DESCRIPTION OF THE SEVERAL VIEWS OF THE DRAWINGS

These and other features and advantages of the present invention will become more readily appreciated when considered in connection with the following detailed description and appended drawings, wherein.

DETAILED DESCRIPTION OF THE INVENTION

Figure 2:
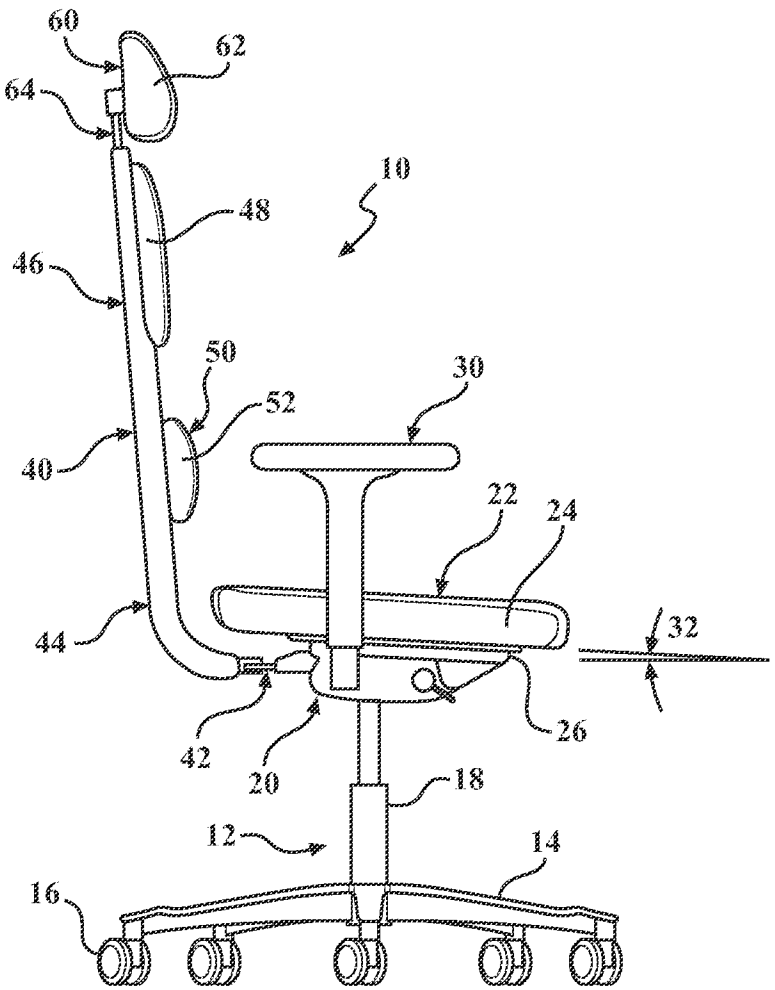
FIG. 2 is a side view the first chair embodiment
Figure 1:
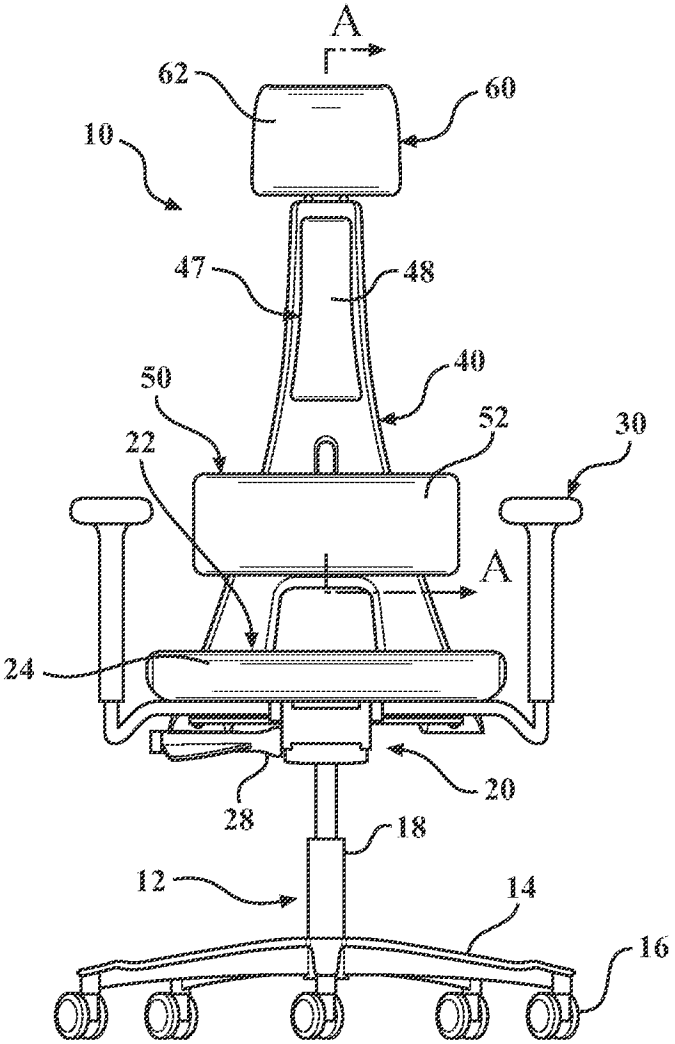
FIG. 1 is a front view of a first chair embodiment

Referring to the figures, wherein like numerals indicate like or corresponding parts throughout the several views, FIG. 1 and FIG. 2 are front and side views, respectively, of a first embodiment of a chair 10. Chair 10 is comprised of a base 12 having a plurality of legs 14 and casters 16 attached to each leg, the wheels or casters adapted to roll upon a floor. The plurality of legs 16 are attached to a vertical support column 18. In one embodiment, support column 18 may be vertically adjusted, such as by telescopic extension.

Support column 18 supports a seat platform 20 rotatably attached to support column 18. Seat platform 20 comprises a topside portion 22. In a preferred embodiment, topside portion 22 comprises a seat cushion 24, though a cushion is not required. If a seat cushion 24 is utilized, it sits on cushion support 26 (shown in FIG. 2). Seat platform 20 may also comprise attachment points for armrests 30, a mechanism to adjust seat platform height (not shown), and a tilt mechanism 28 to control the longitudinal (front-to-back) angle of topside portion 22 of the seat platform. Seat platform 20 may also comprise a mechanism to control recline angle and/or recline resistance of back support frame 40 relative to the seat platform, as well as various other adjustments such as for controlling the rotation and swivel of seat platform 20, adjustments for user weight, arm rest mechanisms, and lumbar adjustments.

Figure 3:
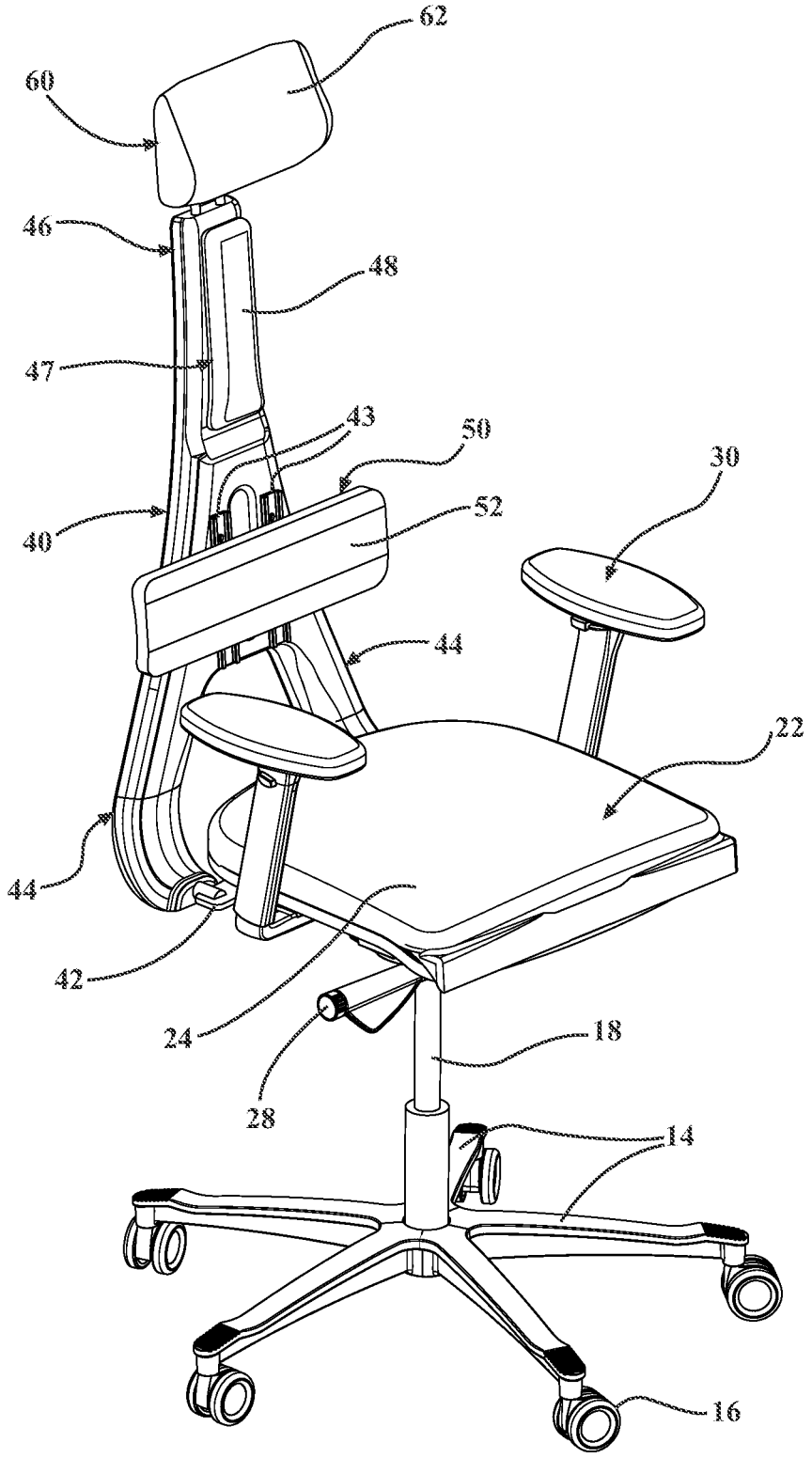
FIG. 3 is a perspective view of the first chair embodiment

Attached to seat platform 20 is a back support frame 40 comprising a lower back support frame 44 at the end that is proximal to seat platform 20, and an upper back support frame 46 terminating at the distal end of back support frame 40. The lower back support frame 44 may attach to seat platform 20 at any number of attachment points 42. Back support frame may be of any configuration. In a first embodiment best shown in FIGS. 1 and 2, back support frame 40 may comprise two laterally-spaced proximal lower frame members 45 that each attach to the underside portion of seat platform 20, the laterally-spaced proximal lower frame members being laterally sider at the proximal end than the distal end. As best shown in FIGS. 1 and 3, the proximal lower frame members 45 may extend back and up, laterally merging into one upper back support frame member 46 at the distal end of back support frame 40, forming an "arrow" shape when viewed from the front. Back support frame 40 may be comprised of metal, plastic, carbon fiber, or a combination thereof. It may be a unitary (unibody) or a plurality of elements welded, screwed, bolted, or otherwise attached together.

Chair 10 may also comprise armrests 30. Armrests 30 may attach to the underside or topside 22 portions of seat platform 20, or to lower back support frame 44. The armrests may be adjustable in the vertical, lateral (side to side) and longitudinal directions. Armrests 30 may also pivot around one or more lateral or longitudinal axes, or retract into a portion of the chair, e.g. the underside of seat platform 20.

Chair 10 may also comprise a lower backrest 50 and a lumbar cushion 52, attached to the back support frame 40. Lower backrest 50 is placed near the proximal end of back support frame 40 to engage with a seated user's lumbar region. Lower backrest 50 is preferably vertically adjustable, and may also be adjustable longitudinally, i.e. normal (perpendicular) to the user's back. The adjustment means may be manual or electric, and comprise complementary rails 43 as shown in FIG. 3, or one or more rods inserted into back support frame 40, into either lower back support frame 44 or into upper back support frame 46. Other adjustment means such as threaded screw(s), gears, cam mechanisms, telescopic tubes, inflatable bladders, or other lumbar adjustment mechanisms known to those skilled in the art may be used either singularly or in combination.

Figure 5:
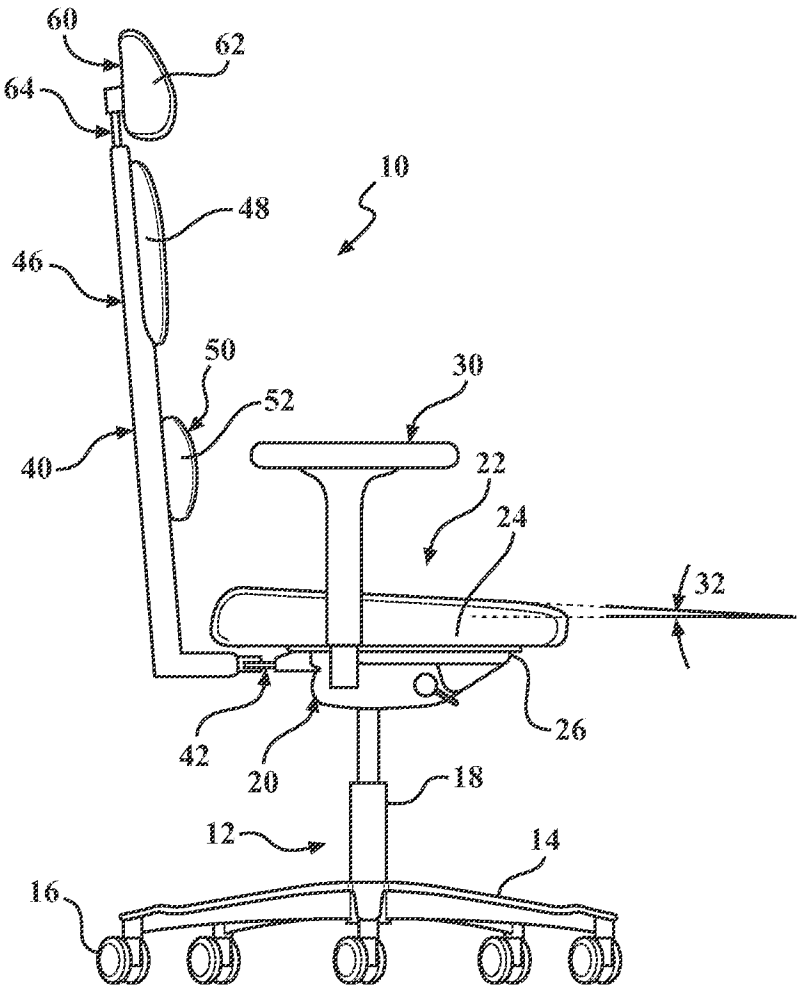
FIG. 5 is a side view of a second embodiment
Figure 4:
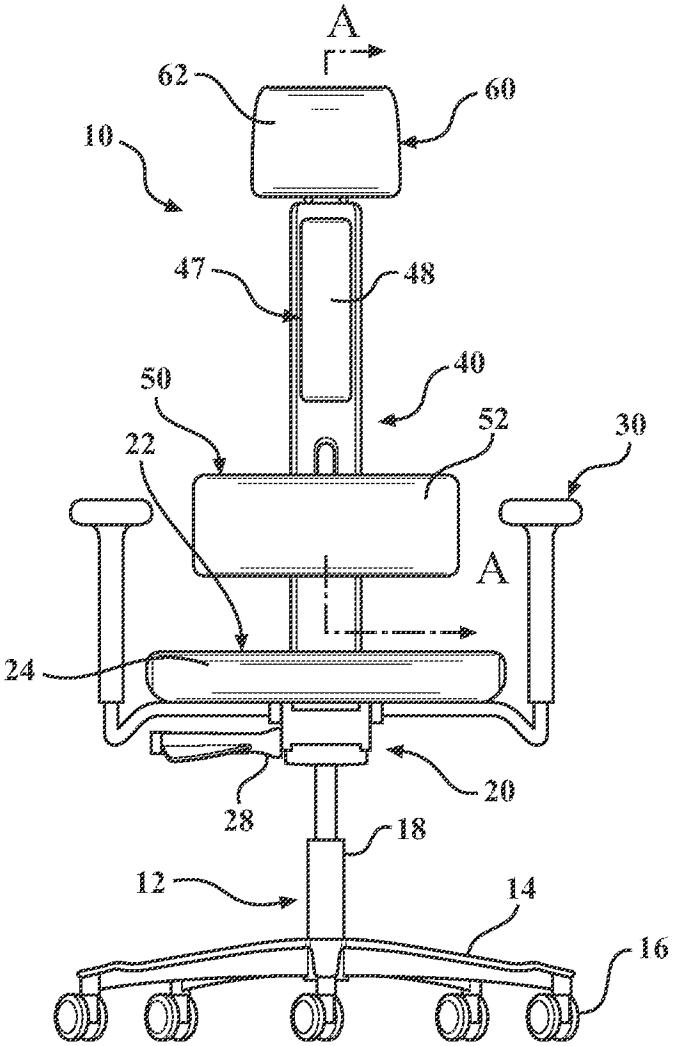
FIG. 4 is a front view of a second chair embodiment

A second embodiment of chair 10 is shown in FIGS. 4 and 5. Unlike the first embodiment shown in FIGS. 1 through 3, the lower back support frame is comprised of one structural element (though not necessarily comprised of only one material) attached to the underside of seat platform 20. In a preferred embodiment, the topside portion 22 of the seat platform 20, typically comprising a seat cushion 24, is slightly tilted longitudinally forward at a seat angle 32. In a preferred embodiment, seat angle is between approximately 2-4 degrees.

Figure 20A:
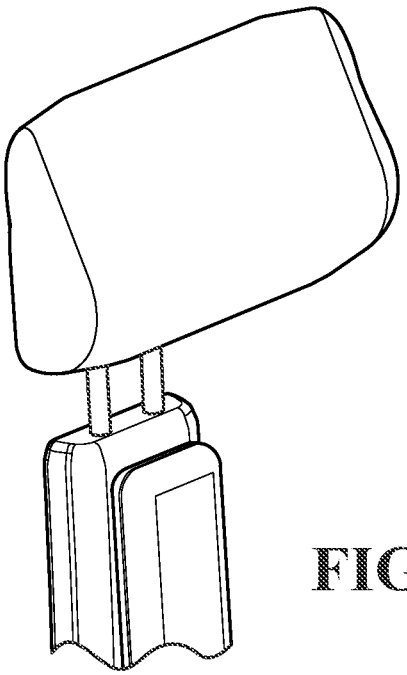
FIG. 20A is a perspective view of an exemplar neckrest and adjustment means
Figure 20B:
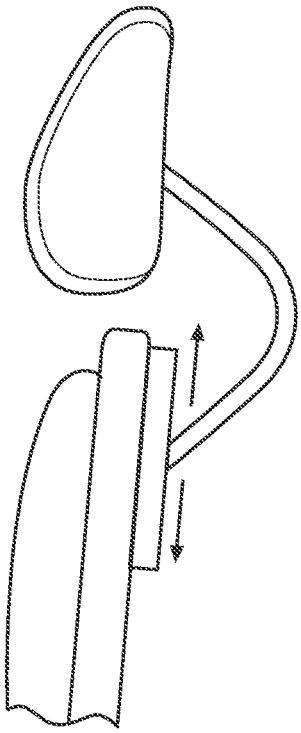
FIG. 20B is a side view of a second exemplar neckrest and adjustment means

Chair 10 may also comprise a neckrest 60 and optionally a neckrest cushion 62 having a front and attached to the distal end of back support frame 40. Like lower backrest 50, neckrest 60 is preferably vertically adjustable, and may also be adjustable longitudinally, i.e. normal (perpendicular) to the user's neck. In a preferred embodiment, neckrest 60 may be structurally secured to upper back support frame 46 by means of a single rod or a plurality of frictionally secured rods as shown in FIG. 20A, or by a complementary rail system as shown in FIG. 20B, or any means of adjustment similar to those described above for adjusting lower backrest 50. In other embodiments, neckrest 60 or neckrest cushion 62 may be combined with another section of chair back cushion (e.g., an extension of a thoracic cushion 48 or thoracic cushion region 78) or may be a separate element attached to the upper portion of midrest 47 by sewing, straps, Velcro, buttons, zipper, etc. (not shown).

Figure 6:
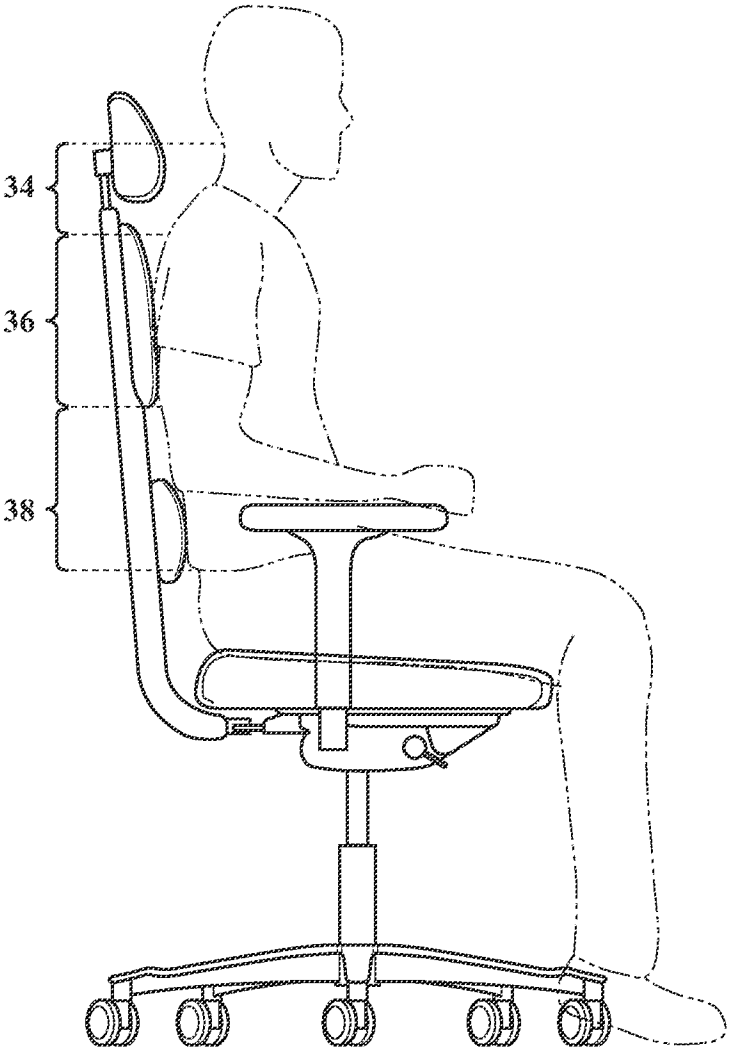
FIG. 6 is a side view of a user shown seated in the first chair embodiment

FIG. 6 profiles a user sitting in the first chair embodiment. The user's spine is comprised of vertebrae including a cervical region 34 with seven cervical vertebrae (conventionally numbered top-to-bottom C1-C7), a thoracic region 36 with twelve thoracic vertebrae (T1-T12), and a lumbar region 38 with five lumbar vertebrae (L1-L5).

Returning to FIG. 1, a midrest 47 is situated between lower backrest 50 and neckrest 60 to support the user's thoracic region 36. Midrest 47 may be separate and spaced apart from lower backrest 50 and separate and spaced apart from neckrest 60. Midrest 47 preferably comprises a forward-facing and centrally situated thoracic cushion 48 placed to normally engage the user's thoracic region 36. Thoracic cushion 48 has a vertical length but its length preferably does not extend above or below thoracic region 36 of a given user. For the embodiment shown in FIG. 6, thoracic cushion 48 engages the seated user's back from about vertebrae T3 through T12 and does not significantly engage with the seated user's back below vertebrae T12.

FIGS. 1, 2 and 3 are, respectively front, side and perspective views of a first chair embodiment. As understood from the front views of the chair embodiments in FIGS. 1 and 4, a user sitting normally in chair 10 feels no pressure/support on the user's scapulae (shoulder blades) because chair 10 has no structure to engage with that region of the user's back. There is likewise an absence of cushioning or supportive structure in the interstitial area between thoracic cushion 48 and lower backrest cushion 52. Consequently, the user's back is supported by the narrow thoracic cushion 48 engaging the thoracic region 36 of the user's spine and by lower backrest cushion 52 engaging lumbar region 38.

In a preferred embodiment the length of thoracic cushion 48 is significantly longer than its width. In a more preferred embodiment, the width of thoracic cushion 48 is less than five inches along its length. In another preferred embodiment, the width of the upper two-thirds of thoracic cushion 48 is less than four inches and the width of the lower third no more than than six inches. Thoracic cushion 48 preferably has a thickness (in the longitudinal dimension) less than two inches or even less than one inch. Thoracic cushion 48 is characterized by a cushion firmness, which may be measured by Indentation Load Deflection (ILD). As is known to those skilled in the art, a plush cushion has a range of about 16.5 ILD to 22.5 ILD, a soft cushion has a range of about 22.5 ILD to 26.5 ILD, a medium cushion has a range of about 26.5 ILD to 30.5 ILD, a firm cushion has a range of about 30.5 ILD to 34.5 ILD, a very firm cushion has a range of about 34.5 to 38.5 ILD, and an extremely firm cushion may have an ILD as high as 50 ILD. In one embodiment, thoracic cushion 48 is at least medium firmness corresponding to an effective ILD above about 26.5. Lumbar cushion 52 and neckrest cushion 62 preferably also have at least medium firmness. For purposes of the specification and the claims "effective ILD" means the human-perceived firmness of a chair element, such as a chair cushion or chair fabric region, that relates most closely with the firmness of a molded urethane foam sample as measured by industry standard ASTM D3574-17.

Figure 7:
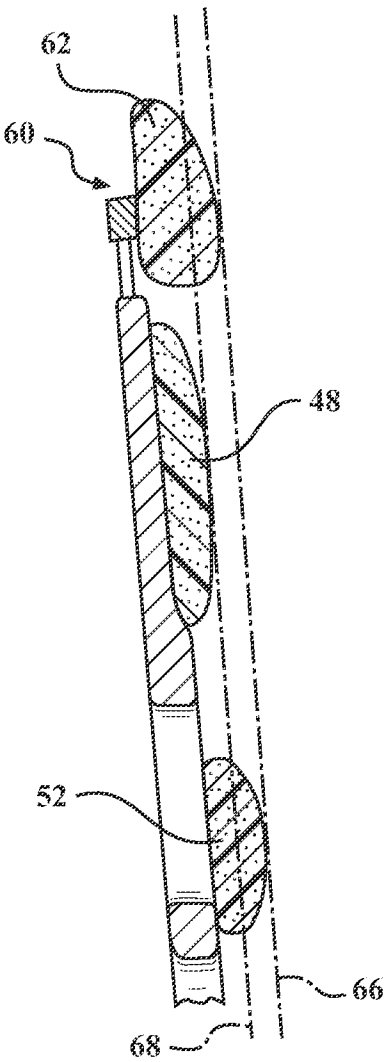
FIG. 7 is an enlarged view of a portion of the chair back in the first embodiment

The front face of thoracic cushion 48 may be generally rectangular as shown in FIG. 4, or have a slightly broader base as shown in FIG. 1, or have any other shape such as examples shown in FIGS. 21A-21E. In a preferred embodiment the front face of thoracic cushion 48 has a generally straight or slightly convex profile as shown in FIG. 7. I.e., the anterior face of thoracic cushion 48 is generally straight or slightly convex as viewed from the side; thoracic cushion 48 has no significant concave curvature to complement the natural dorsal curve of the user's thoracic region 36. Thoracic cushion 48 may be vertically adjustable to accommodate users having different heights or spinal lengths, and may also be longitudinally adjustable, using any adjustment means described above or known to skilled artisans.

Figure 21A:
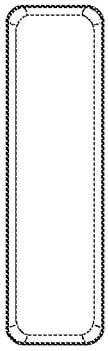
FIG. 21A is a front view of a rectangular thoracic cushion with rounded corners
Figure 21B:
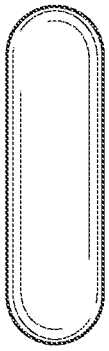
FIG. 21B is a front view of an oblong thoracic cushion
Figure 21C:
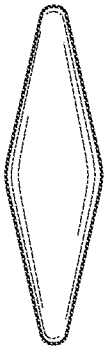
FIG. 21C is a front view of a diamond-shaped thoracic cushion
Figure 21D:
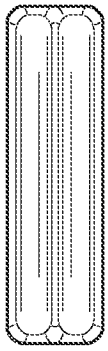
FIG. 21D is a front view of a thoracic cushion having a vertical ventral depression
Figure 21E:
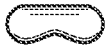
FIG. 21E is an end view of the thoracic cushion having a vertical ventral depression

In another embodiment, thoracic cushion 48 may comprise a ventral depression through its middle, running vertically along some or all of the length of thoracic cushion 48, to center and cradle the thoracic region 36 of the user's spine, that embodiment illustrated in FIGS. 21D and 21E showing the front view and end view respectively of a cradle-shaped thoracic cushion 48. As shown in FIGS. 21D and 21E, the depression in this embodiment laterally centers the user's spine on thoracic cushion 48. Like other embodiments described herein, in this embodiment the side profile of thoracic cushion 48 is generally straight with the anterior front optionally being slightly convex. The front of thoracic cushion 48 does not bend or curve to attempt to complement the dorsal curvature of the user's thoracic region 36.

FIG. 7 shows a side view of a preferred embodiment of the chair back. The front face of neckrest cushion 62 and the front face of lumbar cushion 52 generally define a first plane 66. The front face of thoracic cushion 48 is significantly behind the first plane 66. For embodiments in which thoracic cushion 48 is generally flat and generally defines a second plane 68, as shown in FIG. 7, first plane 66 is located in front of the second plane 68.

FIGS. 8 through 11 illustrate related embodiments in which the chairback comprises a fabric 70 in addition to a thoracic cushion 48 and lumbar cushion 52. Adding fabric 70 may mimic familiar shapes relating to traditional chair designs thereby increasing aesthetic appeal for some users, or be preferred for other reasons unrelated to seating comfort, such as user privacy. Fabric 70 which may be a mesh, leather, or any other textile-like material. A fabric frame 74, which may be comprised of metal, plastic, carbon fiber, or other materials known to those knowledgeable in the art, helps fabric 70 hold its intended shape. Fabric frame 74 may also comprise a reinforced perimeter of fabric 70, such as a rolled and sewn perimeter edge, or an edge that has been treated by heat or chemicals to reinforce or stiffen the material in a desired shape. Fabric 70 may be made in a variety of shapes such as generally deltoid (FIG. 8), trapezoidal (FIG. 9), rectangular (FIG. 10), or oval, pear-shaped, circular, etc.

Figure 11:
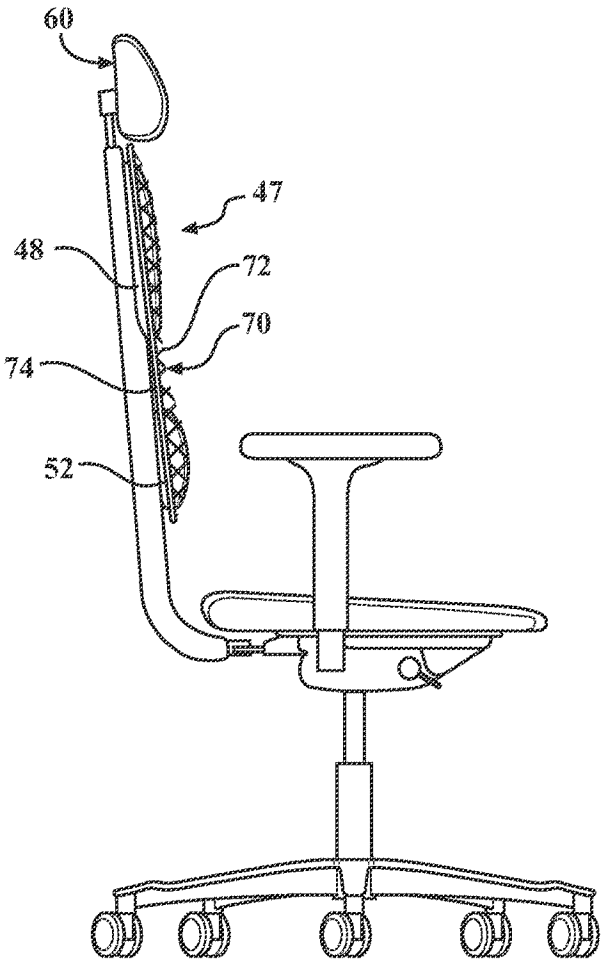
FIG. 11 is a side view essentially common to embodiments 3, 4 and 5

When designed and built appropriately, adding chairback fabric 70 to chair 10 does not significantly reduce the aforementioned functionality of concentrating upper back support to the user's thoracic region 36. Chair fabric 70 may cover thoracic cushion 48 and lumbar cushion 52 as well as interstitial areas 72. As shown in FIGS. 8-11, interstitial areas 72 correspond to regions of the chairback that are not longitudinally adjacent to thoracic cushion 48, to lumbar cushion 52, or to neckrest cushion 62. The chairback at interstitial areas 72 has substantially less firmness than these supportive cushions, thereby providing little or no support to a user's back normal to interstitial areas 72. In one embodiment, thoracic cushion 48 and lumbar cushion 52 have limited deflection capacity because of 1) relatively shallow cushion depth and 2) firmness corresponding to an effective ILD above about 28. In contrast, chair fabric 70 over the interstitial areas 72 has 1) substantially greater deflection capacity and 2) are substantially less firm, and in a preferred embodiment a softness corresponding to an effective ILD below about 24. Consequently, a user sitting in any of the embodiments shown in FIGS. 8 through 11 does not experience significant pressure or support on areas normal to interstitial areas 72, including on the user's scapulae (shoulder blades) or on the user's back between lumbar cushion 52 and thoracic cushion 48. Moreover, as best shown in FIG. 11, some fabrics such as certain meshes, are subjected to varying tension after being stretched over and around cushions and fabric frame 48. Chair fabric 70, under uneven fabric tension, tends to cling closely to the front surface of thoracic cushion 48 and lumbar cushion 52, but tends to contract and subside rearward in interstitial areas 72, thereby further reducing the firmness and decreasing any support fabric 70 provide to the user's back normal to interstitial areas 72.

Figure 9:
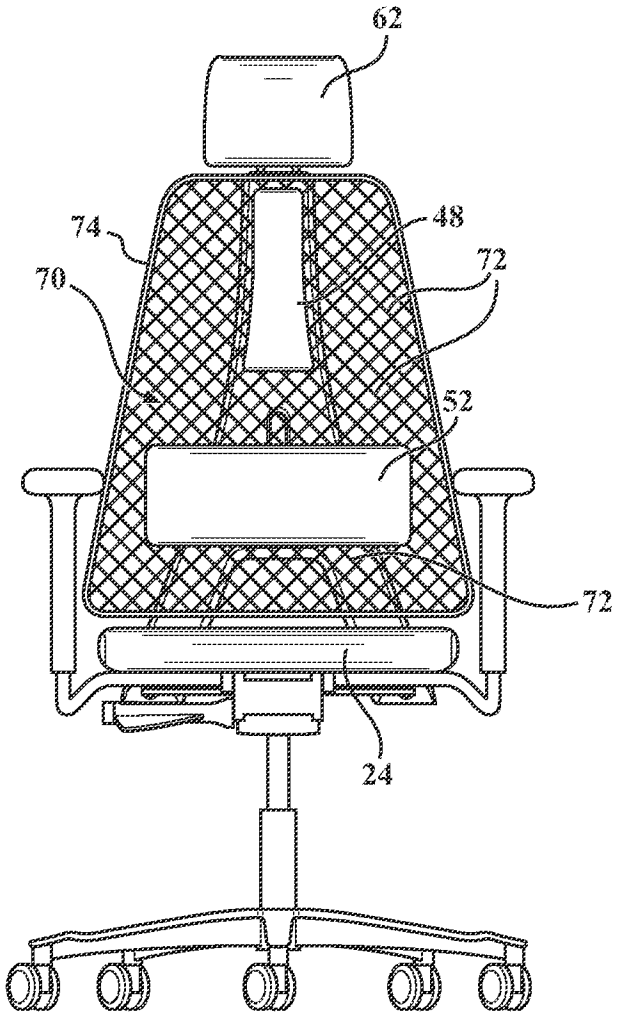
FIG. 9 is a front view of a fourth embodiment
Figure 8:
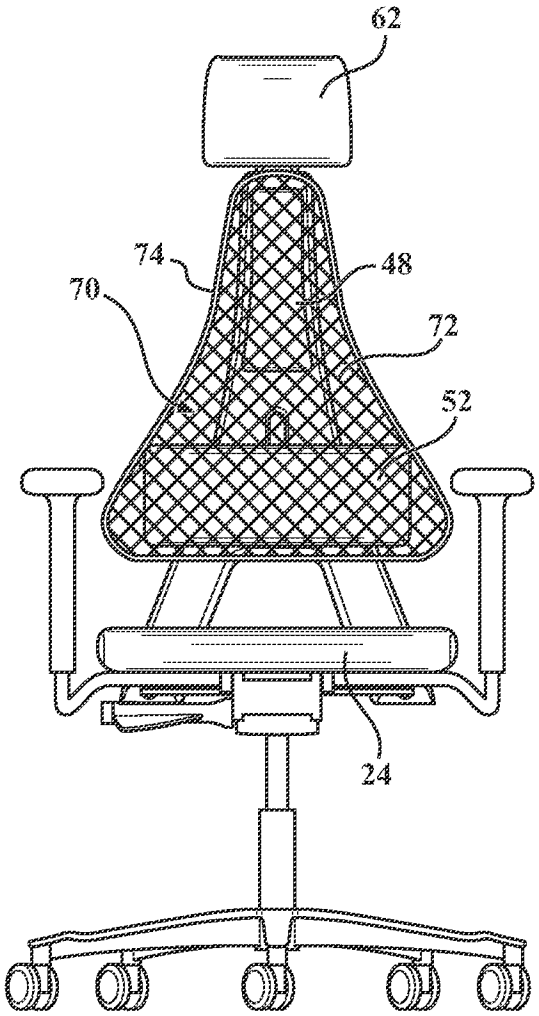
FIG. 8 is a front view of a third embodiment
Figure 10:
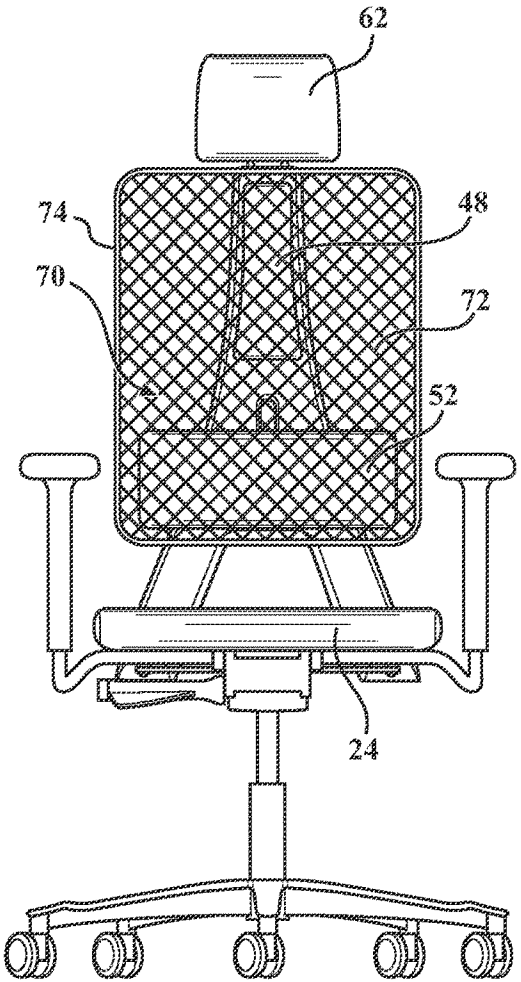
FIG. 10 is a front view of a fifth embodiment
Figure 12B:
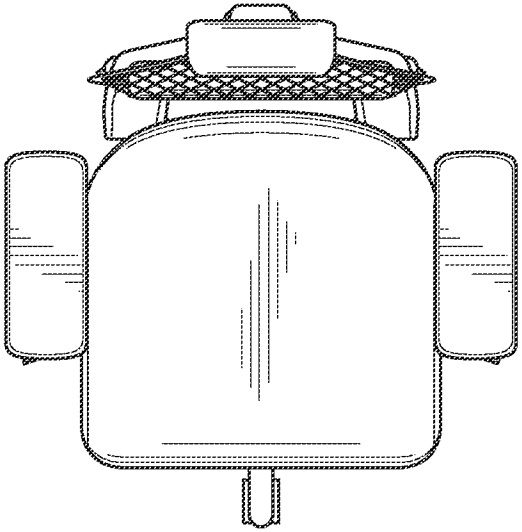
FIG. 12B is a top view of the third embodiment
Figure 12A:
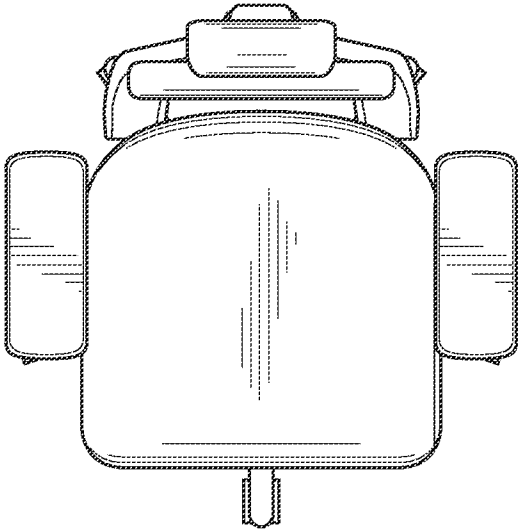
FIG. 12A is a top view of the first embodiment
Figure 12D:
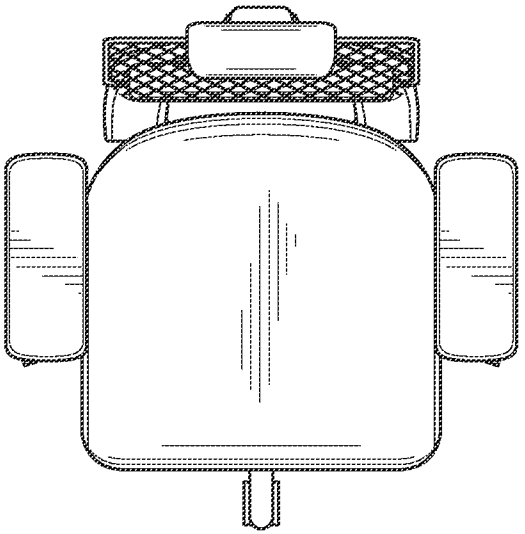
FIG. 12D is a top view of the fifth embodiment
Figure 12C:
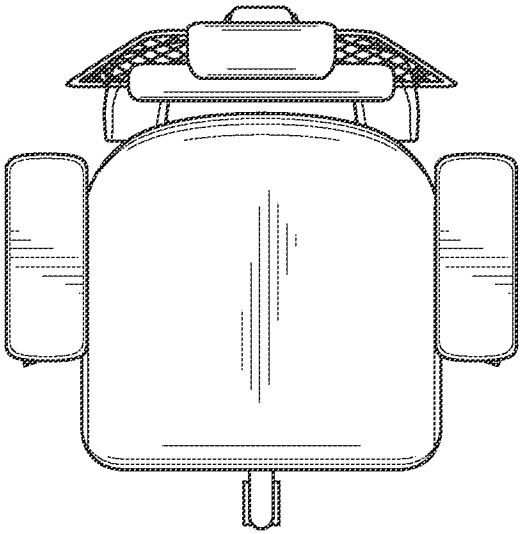
FIG. 12C is a top view of the fourth embodiment

Chairback fabric 70 may unitarily cover the lateral expanse of midrest 47, or cover the entire chairback including neckrest 62, or only partially cover the chairback. Chairback fabric 70 and chairback frame 74 may extend below lumbar cushion 52 as shown in FIG. 8, or be attached to and/or cover seat cushion 24 (not shown), or extend below seat cushion 24 as shown in FIG. 9. Chairback fabric may cover the front of both thoracic cushion 48 and lumbar cushion 52 as shown in FIGS. 8, 10 and 11. In another embodiment shown in FIG. 9, chair fabric 70, is placed so as to frontally expose thoracic cushion 48 and lumbar cushion 52. Such exposure can be accomplished in many ways such as by bordering chair fabric 70 around the perimeter of the cushions, or placing fabric 70 behind the cushions. In another embodiment (not shown) chair fabric 70 may cover one cushion but not the other. In another embodiment, chairback fabric 70 may be comprised of a plurality of pieces of fabric, and/or a plurality of fabric types.

Figure 15:
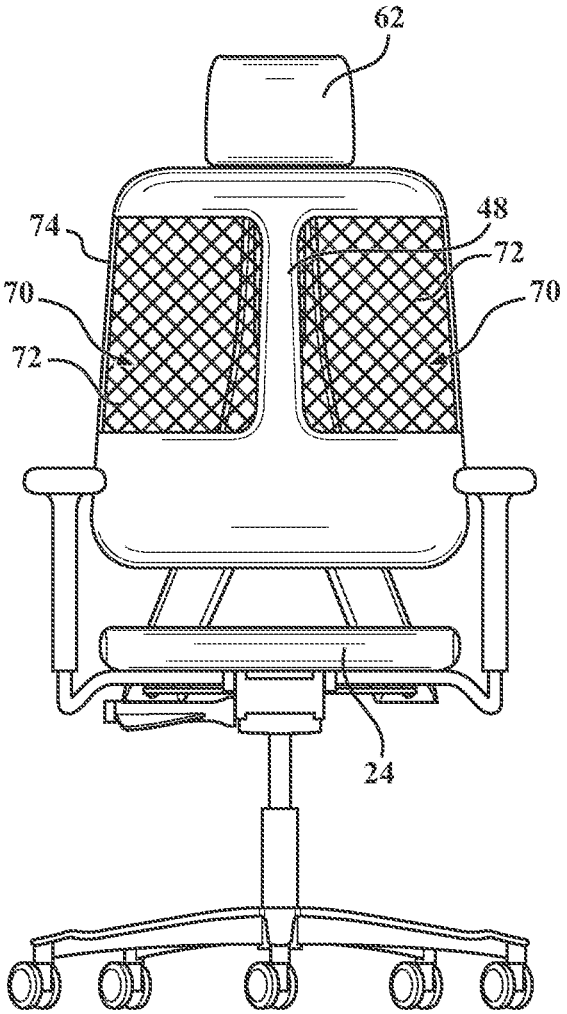
FIG. 15 is a front view of an eighth embodiment

FIG. 15 shows another embodiment of a chairback comprising a thoracic cushion 48 and chair fabric 70 covering interstitial areas 72. In this embodiment, interstitial areas 72 include regions normal to a user's scapulae, but the chairback comprises an upper transverse element immediately above the user's scapulae that can provide some structural support. This embodiment functions similarly to the earlier embodiments having a generally open shoulder design, while possibly being more aesthetically pleasing to some users.

Figure 13:
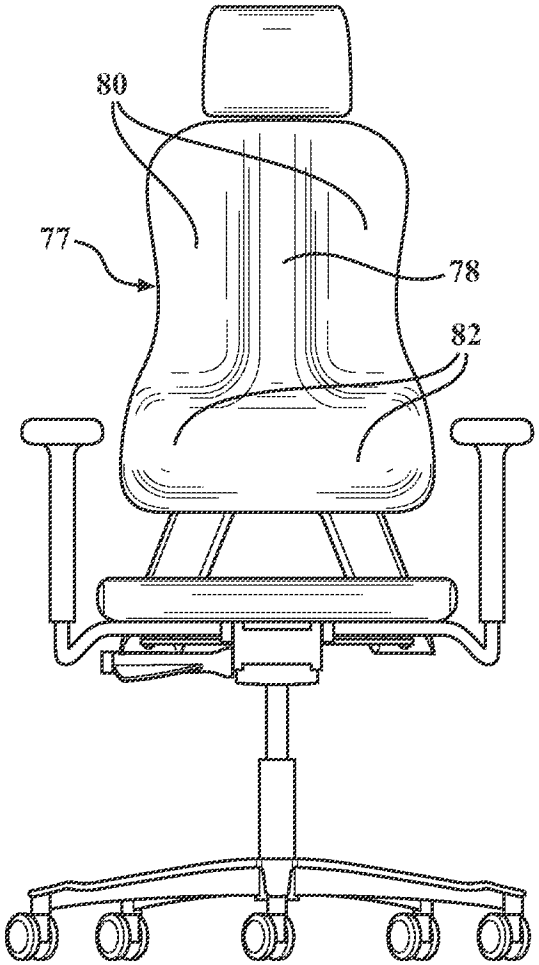
FIG. 13 is a front view of a sixth embodiment showing a chair having cushion regions

The same functional effect can be achieved by structuring a chairback with a single back cushion body having a plurality of regions, with firmer and/or more elevated support in some regions and softer and/or lower elevation of support in others. It is known to fabricate a cushion or mattress characterized by a plurality of regions having different levels of firmness or height elevation. As shown in FIG. 13, chairback 77 may be attached to back support frame 40 between the frame's proximal end and the distal end. Chairback 77 may comprise a cushion having a plurality of regions. Thoracic cushion region 78 is vertically oriented in the lateral center of chairback 77, located above lumbar cushion 82. The location of thoracic cushion region 78 corresponds generally to the location of above described thoracic cushion 48. Thoracic cushion region 78 is vertically longer than wide. Scapular cushion region 80 is situated on either lateral side of thoracic cushion region 78 and above lumbar cushion region 82. Lumbar cushion region 82 is below and normal to the seated user's lumbar region 38.

Figure 14:
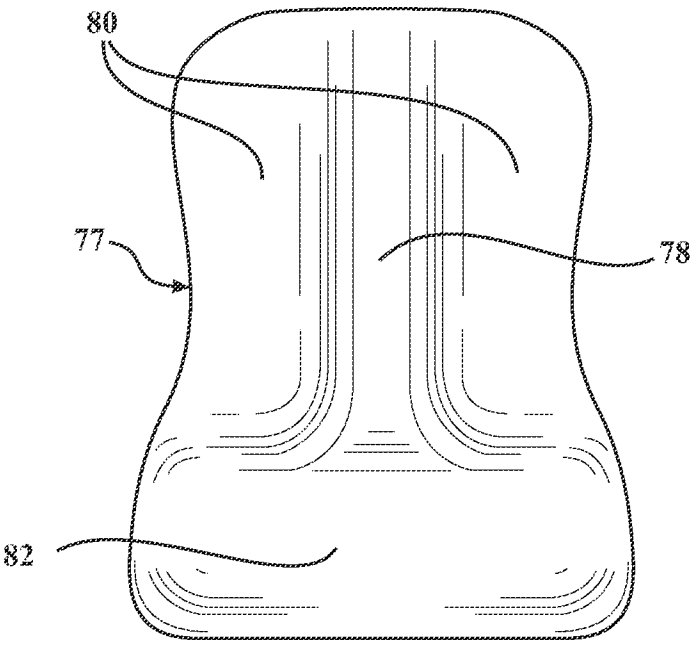
FIG. 14 is a front view of a seventh embodiment showing a chairback having cushion regions

Demarcating the boundaries between thoracic cushion region 78, scapular cushion region 80, and lumbar cushion region 82 may be accomplished by fabricating chairback 77 with these regions having differing firmness levels. Preferably the firmness of thoracic cushion region 78 is substantially higher than the firmness of scapular cushion regions 80. For example, thoracic cushion region 78 may be firm and have an effective ILD above about 28, and scapular cushion region 80 may be soft and have an effective ILD below about 24. In another embodiment, demarcation may be accomplished by fabricating chairback 77 with the regions having varying cushion height/elevation. In the embodiment shown in FIG. 14, thoracic cushion region 78 has a significantly higher anterior elevation than scapular cushion region 80 (elevation of the cushion regions being measured relative to a chairback plane such as second plane 68 illustrated in FIG. 7) effectively forming a narrow "ridge" normal to the user's thoracic region 36. In a preferred embodiment, elevated thoracic cushion region 78 is generally flat or slightly convex. In another embodiment, thoracic cushion region 78 may comprise a central depression running within the elevated ridge to cradle the user's spine, as illustrated in FIGS. 21D (front view) and 21E (end view).

In other embodiments, chairback 77 may comprise a cushion whereby the regions are demarcated by a combination of varying cushion firmness and varying elevation. The functional outcome of thoracic cushion region 78 being firmer and/or higher than nearby scapular cushion region 80 is that chairback 77 primarily supports the seated user's thoracic spinal region 36 and only minimally engages with the seated user's scapulae. The thoracic cushion region's anterior elevation may be higher and/or firmer than the proximately adjacent scapular cushion region thereby creating a ridge, such that the upper portions of chairback 77 primarily support the seated user's thoracic spinal region and only minimally engages with the seated user's scapulae. Similarly, lumbar cushion region 82 may comprise a cushion having a higher anterior elevation and/or degree of firmness than both thoracic cushion region 78 and scapular cushion region 80. Lumbar cushion region 82 may comprise a cushion being more firm than nearby areas. As in all other embodiments described above, the thoracic cushion region 78 and lumbar cushion region 82 may be vertically or longitudinally adjustable using means described above and known to those skilled in the art.

Figure 16:
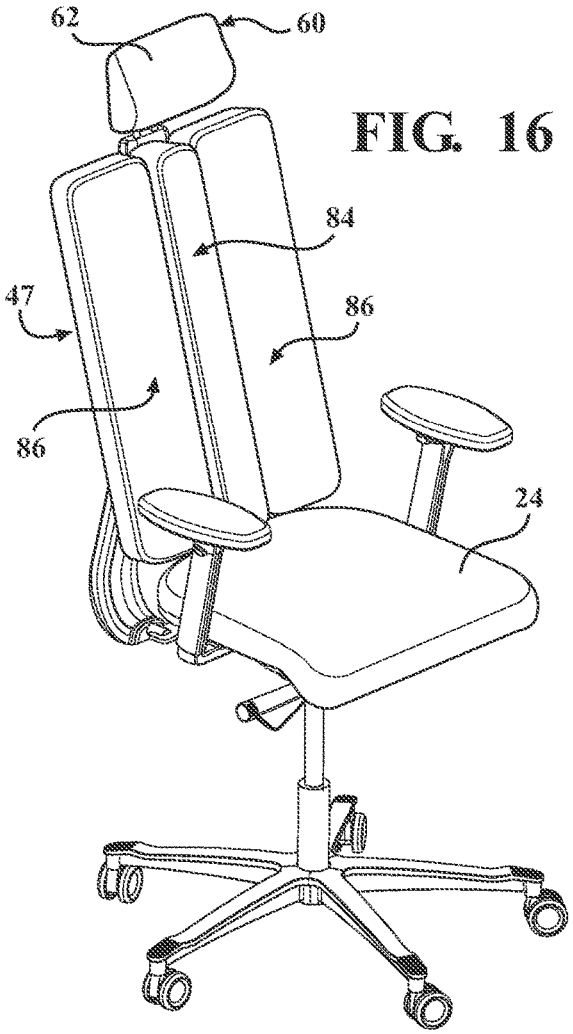
FIG. 16 is a perspective view of a ninth embodiment in rest position
Figure 17:
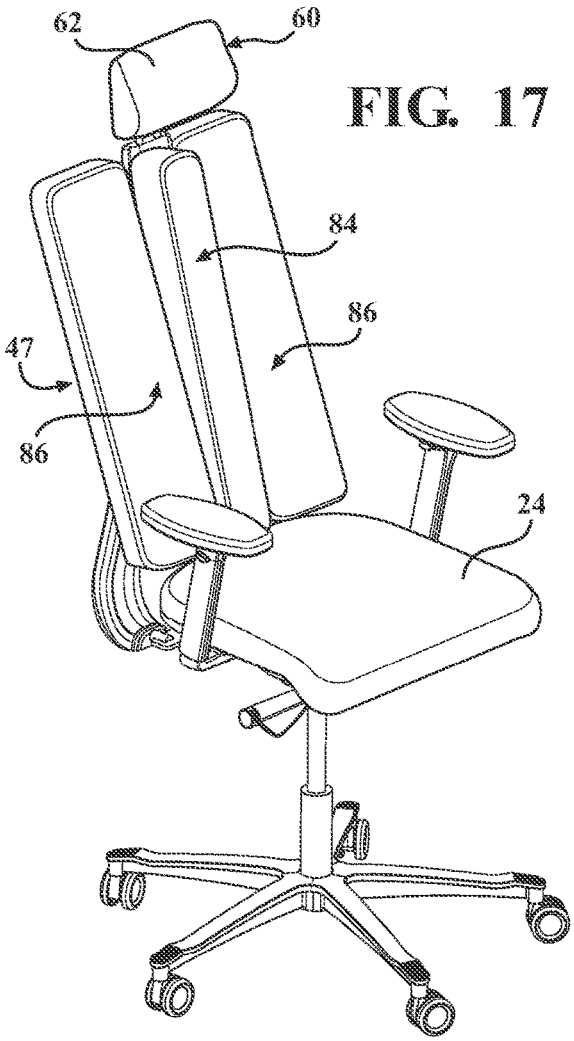
FIG. 17 is a perspective view of the ninth embodiment in deflected position

Another embodiment of the invention is shown in FIGS. 16-19. FIG. 16 shows a perspective view of a chair midrest 47 at rest position, and FIG. 17 shows the same chair in a deflected position. Midrest 47 comprises a central element 84 which may be generally flat and having a relatively narrow width and a front/anterior face, attached to and extending upward from seat platform 20. Central element 84 has a first means for resisting deflection of central element 84. The chairback further comprises two side elements 86 on either side and laterally adjacent to central element 84, similarly extending upward from seat platform 20, the side elements 86 also optionally being generally flat and each wider than central element 84 and each having a front/anterior face, and each side element 86 having a second means for resisting deflection of side elements 86. FIGS. 16 and 17 show an embodiment where side elements 86 deflect away from the user's body by increasing the recline angle about a spring-like attachment to resist deflection, or a pivot mechanism with spring or torsion resistance. It is understood that deflection could be via a rearward translational motion with appropriate translational linkage, or some combination of spring, torsion control, translation, or pivot mechanisms.

Figure 18:
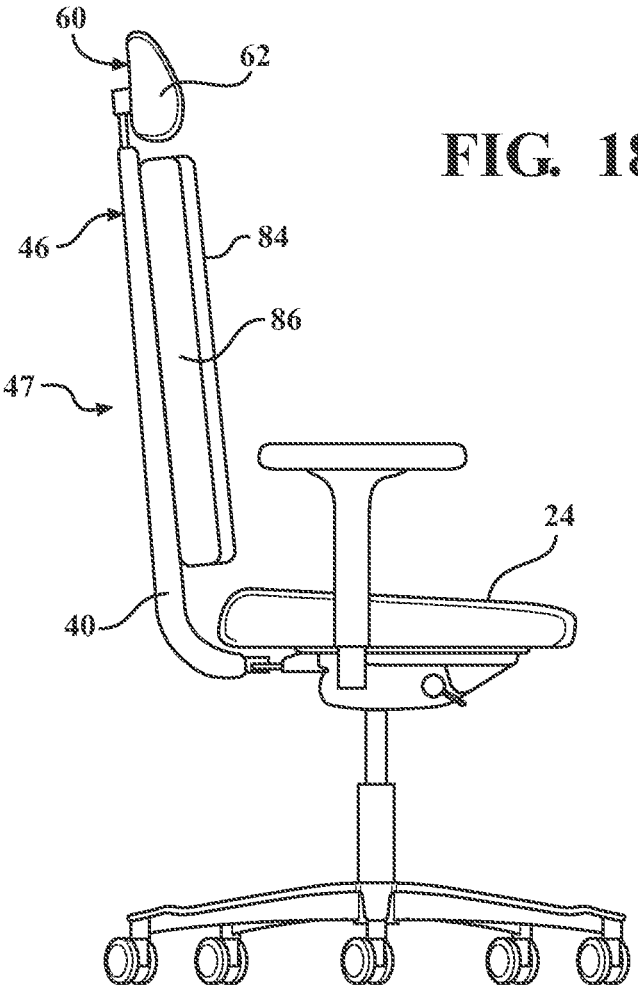
FIG. 18 is a side view of the ninth embodiment in rest position
Figure 19:
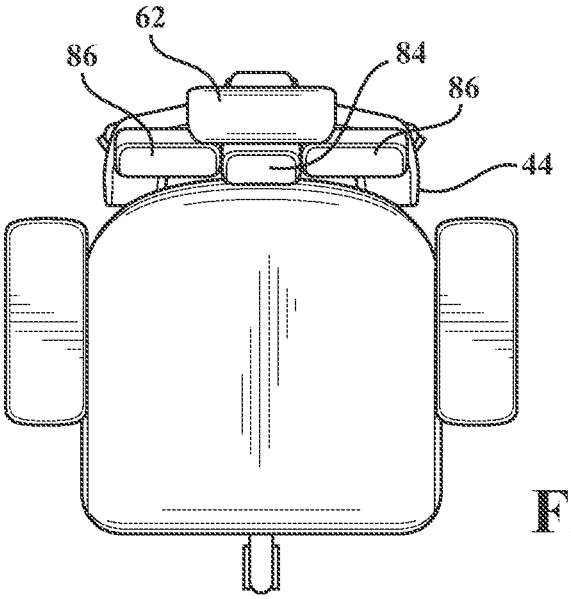
FIG. 19 is a top view of the ninth embodiment in rest position

In the embodiment shown, the first means of resisting rearward deflection for central element 84 is substantially stronger/higher than the second means of resisting rearward deflection for side elements 86. As shown in FIG. 18, the face of central element 84 is positioned forward of the face of side elements 86. Thus when a user sits and applies pressure to the chairback, most or substantially all of the user's back is supported by central element 84 applying pressure to the user's thoracic region because side elements 86 deflect more easily than central element 84, thus little support/pressure is experienced by the user at the scapulae. This multi-element chairback embodiment may optionally comprise a neckrest 60 and neckrest cushion 62, and may further comprise an integrated or separate lower backrest support 50 or lumbar cushion 52.

The foregoing invention has been described in accordance with the relevant legal standards, thus the description is exemplary rather than limiting in nature. Variations and modifications to the disclosed embodiment may become apparent to those skilled in the art and fall within the scope of the invention. Furthermore, particular features of one embodiment can replace corresponding features in another embodiment or can supplement other embodiments unless otherwise indicated by the drawings or this specification.

We claim:

1. A chair for a human user having scapulae and further having lumbar and thoracic spinal regions, said chair comprising:

a seat platform;

a back support frame having a proximal end and a distal end extending above the proximal end, the proximal end attached to the seat platform;

a vertically adjustable lumbar cushion having a lateral width and a front for engaging the lumbar region;

a midrest attached to the back support frame between the lumbar cushion and the distal end for supporting the thoracic region, said midrest separate and spaced apart from the lumbar cushion, said midrest comprising a vertically oriented, substantially elongated thoracic cushion having a width and a generally vertical length and a front and an effective initial load deflection (ILD) firmness;

one or more interstitial areas laterally proximate to the thoracic cushion;

a chairback fabric attached to a fabric frame, the fabric frame configured to allow the fabric to hold an intended shape, the chairback fabric and fabric frame attached to the back support frame and unitarily covering a lateral expanse of the midrest and the lumbar cushion, the chairback fabric and fabric frame extending across at least one interstitial area, wherein the chairback fabric covering the interstitial area that is laterally proximate to the thoracic cushion has an interstitial effective initial load deflection (ILD) firmness;

wherein the thoracic cushion is less than five inches wide along at least two thirds of its length; and wherein the thoracic cushion effective initial load deflection (ILD) firmness is substantially higher than the interstitial effective initial load deflection (ILD) firmness such that the midrest primarily supports the seated user's thoracic spinal region and only minimally engages with the seated user's scapulae.

2. The chair of claim 1 wherein the chairback fabric is in direct contact with the thoracic cushion and with the lumbar cushion, the chairback fabric extending across at least the width of the thoracic cushion and the width of the lumbar cushion.

3. The chair of claim 1 further comprising a seat cushion on top of the seat platform, and further comprising a fabric frame, wherein the fabric frame extends below the seat cushion.

4. The chair of claim 1 wherein the chairback fabric is in front of at least one cushion selected from the group consisting of: thoracic cushion and lumbar cushion.

5. The chair of claim 1 wherein the chairback fabric is behind at least one cushion selected from the group consisting of: thoracic cushion and lumbar cushion.

6. The chair of claim 1 further comprising a neckrest cushion having a front for engaging a cervical region of the user's spine, wherein the neckrest cushion front and the lumbar cushion front generally define a first plane, and wherein the thoracic cushion front is behind the first plane.

7. The chair of claim 1 wherein the thoracic cushion effective initial load deflection (ILD) firmness is above twenty-eight and the interstitial area effective initial load deflection (ILD) firmness is below twenty-four.

8. A chair for a human user having scapulae and a thoracic spinal region, said chair comprising:

a seat platform having an anterior front; and a chairback comprised of a central element attached to the seat platform and extending generally upwards and having a front surface, said central element having a first means for resisting central element recline relative to the seat platform, and further comprising two chairback side elements each attached to the seat platform and extending generally upwards and situated laterally adjacent to said central element, said side elements each having a front surface, further wherein each side element is wider than the central element, and further wherein the side elements have a second means for resisting side element recline relative to the seat platform, wherein recline of the central element relative to the seat platform is independent from recline of the side elements relative to the seat platform, and wherein the first means of resisting central element recline is stronger than the second means of resisting side element recline, thereby concentrating thoracic support on the spine when the user sits with minimal support of the user's scapulae.

9. The chair of claim 8 wherein the front surface of the central element is anterior to the front surface of both side elements.

* * * * *